US007176841B2

(12) United States Patent
Fukuda

(10) Patent No.: US 7,176,841 B2
(45) Date of Patent: Feb. 13, 2007

(54) ANTENNA DEVICE AND RADIO COMMUNICATION APPARATUS USING THE ANTENNA DEVICE

(75) Inventor: Junichi Fukuda, Tokyo (JP)

(73) Assignee: NEC Corporation, Tokyo (JP)

( * ) Notice: Subject to any disclaimer, the term of this patent is extended or adjusted under 35 U.S.C. 154(b) by 69 days.

(21) Appl. No.: 11/006,559

(22) Filed: Dec. 8, 2004

(65) Prior Publication Data

US 2005/0128155 A1 Jun. 16, 2005

(30) Foreign Application Priority Data

Dec. 11, 2003 (JP) ..... 2003-413219

(51) Int. Cl.
*H01Q 9/00* (2006.01)

(52) U.S. Cl. ..... 343/745; 343/860

(58) Field of Classification Search ..... 343/747, 343/806, 860, 745, 750; 455/193, 558, 557; 342/357.1

See application file for complete search history.

(56) References Cited

U.S. PATENT DOCUMENTS

| | | | | |
|---|---|---|---|---|
| 4,334,230 | A * | 6/1982 | Kane | 343/797 |
| 4,381,566 | A * | 4/1983 | Kane | 455/193.3 |
| 4,814,776 | A | 3/1989 | Caci et al. | 343/702 |
| 6,362,789 | B1 | 3/2002 | Trumbull et al. | 343/700 MS |
| 7,043,269 | B2 * | 5/2006 | Ono et al. | 455/558 |

FOREIGN PATENT DOCUMENTS

| | | |
|---|---|---|
| EP | 0 617 520 A2 | 9/1994 |
| EP | 0 883 455 A2 | 4/1998 |
| EP | 0 982 796 A2 | 3/2000 |
| EP | 1 052 723 A2 | 11/2000 |
| JP | 2001-24431 | 9/2001 |
| JP | 2001-326514 | 11/2001 |
| JP | 3399545 | 4/2003 |

OTHER PUBLICATIONS

European Search Report dated Feb. 17, 2005.

* cited by examiner

*Primary Examiner*—Tuyet Vo
*Assistant Examiner*—Jimmy Vu
(74) *Attorney, Agent, or Firm*—Whitham, Curtis, Christofferson & Cook, PC

(57) ABSTRACT

An electrical signal is fed from one terminal of an antenna element, and the other terminal thereof is terminated by a variable reactance circuit. A reactance value of the variable reactance circuit is changed according to use state of a device to optimally set its directivity. Matching conditions at an electricity feeding point are controlled to match an impedance of the electricity feeding point which fluctuates according to the value of the variable reactance circuit. With the above construction, there are provided an antenna device that is downsized, can control its directivity, and does not deteriorate a communication quality depending on a use state, and a radio communication apparatus provided with the antenna device.

16 Claims, 7 Drawing Sheets

ANTENNA DEVICE AND RADIO COMMUNICATION APPARATUS USING THE ANTENNA DEVICE

BACKGROUND OF THE INVENTION

1. Field of the Invention

The present invention relates to an antenna device suitably used in a radio communication apparatus such as a cellular phone, or a radio communication apparatus such as a WLAN (wireless local area network) or an RFID (radio frequency identification).

2. Description of the Related Art

In recent mobile communication systems, various services other than a telephone call have been under study such as data communication or TV telephone using web browsing, a position information detection service using a GPS (global positioning system), or authentication and accounting using the RFID (radio frequency identification).

With the above study, the radio communication apparatus such as the cellular phone has been demanded to have a large number of functions in order to deal with various services. In addition, the radio communication apparatus has been demanded to stabilize the communication quality irrespective of the use state of the radio communication apparatus.

In general, the radio communication apparatus of the mobile type always changes its direction or inclination with respect to a communication party (base station) depending on its use state. It is assumed that, as a use state, a call in a state where the radio communication apparatus is made close to his head, or the user holds the radio communication apparatus apart from his head to conduct data communication other than a call. Even in the radio communication apparatus of the mobile type which always changes the use state according to the contents of the service, an antenna device that is stabilized in communication quality, particularly reception sensitivity has been demanded.

In general, the reception sensitivity of the antenna changes according to the direction or inclination with respect to the base station, which does not apply to the radio communication apparatus of the mobile type alone. As one countermeasure for preventing the deterioration of the reception sensitivity, there has been known an antenna diversity technique that uses a plurality of antenna elements, and selects the antenna element that is the highest in the reception sensitivity and receives communication data. However, because the plurality of antenna elements is required to be mounted, the antenna diversity technique is improper for the radio communication apparatus of the mobile type to be downsized.

Also, the radio communication apparatus deteriorates the reception sensitivity even due to the absorption of electric waves into an approaching human body. As a countermeasure for preventing the deterioration of the reception sensitivity, there has been known a method of controlling the directivity (radiating direction of the electric waves) of the antenna. As an example of controlling the directivity of the antenna, there is an array antenna technique that uses a plurality of antenna elements and synthesizes the electric waves that are radiated from the respective antenna elements by feeding signals different in phase and amplitude to the respective antenna elements. The array antenna technique is improper for the radio communication apparatus of the mobile type to be downsized because the antenna elements need to be arranged at given intervals, which leads to a large antenna device.

Also, there has been disclosed a technique of producing an arbitrary directivity by adding a reactance variable element or circuit to each of a plurality of non-electricity-feed antennas which are arranged in a circle about a electricity-feed antenna (Roger F. Harrington, "reactive controlled directive arrays", IEEE transactions on antennas and propagation, vol. AP26, No. 3, May 1978, p390 to 395). In the technique, electric lengths of the non-electricity-feed antenna elements are so changed as to produce the arbitrary antenna directivity mainly on the horizontal plane (the same polarization plane). Also, an ESPAR (electronically steerable passive array radiator) antenna using the above principle has been disclosed in JP 2001-024431 A. In those techniques, because an electrical signal is fed to only one antenna element, a signal processor circuit is simplified more than the above array antenna to suppress an increase in power consumption. However, in order to change the directivity in a range of practical use, it is necessary to provide about 4 to 6 non-electricity-feed antenna elements, and therefore the above techniques are improper for the radio communication apparatus of the mobile type to be downsized.

Also, as an example of controlling the directivity of the antenna, Japanese Patent No. 3399545 discloses an antenna device that is made up of one electricity-feed antenna element and one non-electricity-feed antenna element. The antenna device suffers from such a problem that the controllable directivity pattern is limited.

In addition, JP2001-326514A discloses an antenna device in which the termination of a loop antenna is changed over between two states of short-circuited state and open state to change the directivity (vertical polarization or horizontal polarization). The antenna device can select the directivity according to the use state of the radio communication apparatus since the polarization plane can be controlled. However, the controllable directivity is limited to two directions. Also, it is necessary to provide an antenna element having a length as long as one wavelength of the frequency to be used because the loop antenna is used. Therefore, the entire antenna device is relatively large in size, and it is difficult to incorporate the antenna device into the radio communication apparatus of the mobile type.

The conventional antenna devices as described above suffers from such problems that the directivity of the antenna is limited, and the number of antenna elements is increased, or the antenna per se becomes large in size.

SUMMARY OF THE INVENTION

The present invention has been made to solve the above problems, and therefore an object of the present invention is to suppress deterioration of_reception sensitivity by adaptively controlling antenna directivity even if its direction or inclination with respect to a base station is changed according to a use state of a radio communication apparatus. Also another object of the present invention is to attain a miniaturization without an antenna projecting from a radio communication apparatus.

In order to attain the above-mentioned object, the present invention provides an antenna device, including: a variable reactance circuit having a reactance value variable on the basis of a control signal; an RF (radio frequency) circuit having a matching circuit at an output side; an antenna element having one end to which an electrical signal is fed from the RF circuit and the other end terminated by the variable reactance circuit; and a reactance and matching control circuit that outputs the control signal for setting the reactance value of the variable reactance circuit to a predetermined value.

The antenna element includes three portions. Also, the antenna element may be divided into at least two pieces at a predetermined interval.

In the antenna device, the variable reactance circuit includes: a varactor diode having a capacitor changed according to a signal from the outside; a strip line that is, inserted between the antenna element and the varactor diode; and a coil that is connected in parallel with the varactor diode.

In the antenna device, the reactance and matching control circuit conducts control to change an antenna matching constant with respect to the matching circuit in the RF circuit in synchronism with the control signal for setting the reactance value of the variable reactance circuit to the predetermined value.

Also, the antenna device may further include any one of a use mode judgement circuit that detects a use state of the antenna device, a position detection circuit that detects a direction or inclination of the antenna device, and a reception measurement section for measuring a reception quality of the antenna device.

In the antenna device, the reactance and matching control circuit makes the variable reactance circuit change the reactance value and the RF circuit changes the matching constant according to a detection result that is outputted from any one of the use mode judgement circuit, the position detection circuit, and the reception measurement section.

Also, the antenna device may further include a memory circuit that stores optimum reactance values corresponding to the use state, the direction, the inclination, and the reception quality of the antenna device.

In the antenna device, the reactance and matching control circuit reads the optimum reactance value stored in the memory circuit according to the detection result that is outputted from any one of the use mode judgement circuit, the position detection circuit, and the reception measurement section to make the variable reactance circuit change the reactance value, and make the RF circuit change the matching constant.

Meanwhile, a radio communication apparatus according to the present invention may include a plurality of the antenna devices, the radio communication apparatus selecting any one from the plurality of antenna devices, or selecting and synthesizing two or more of the antenna devices to provide a reception signal.

In the antenna device constituted as described above, an electrical signal is fed from one terminal of the antenna element, and the other terminal of the antenna element is terminated by a variable reactance element of a lumped constant, to appropriately adjust an electric length of the antenna element, and also to make the antenna element length shorter than a predetermined value. Accordingly, there can be realized an antenna device relatively small in size and simple in structure.

In addition, because the antenna directivity can be readily controlled by adjusting the reactance value, the deterioration of reception sensitivity can be suppressed, and a communication quality can be improved.

Also, even if the impedance at an electricity feeding point is changed by changing a reactance value used at the termination, the conditions of a matching circuit in an RF circuit are so controlled as to make reception sensitivity the optimal.

BRIEF DESCRIPTION OF THE DRAWINGS

The above and other objects, features and advantages of the present invention will become more apparent from the following detailed description when taken in conjunction with the accompanying drawings wherein.

DETAILED DESCRIPTION OF THE PREFERRED EMBODIMENTS

Hereinafter, a description will be given in more detail of an antenna device and a radio communication apparatus using the antenna device according to the present invention with reference to the accompanying drawings.

(First Embodiment)

Figure 1:
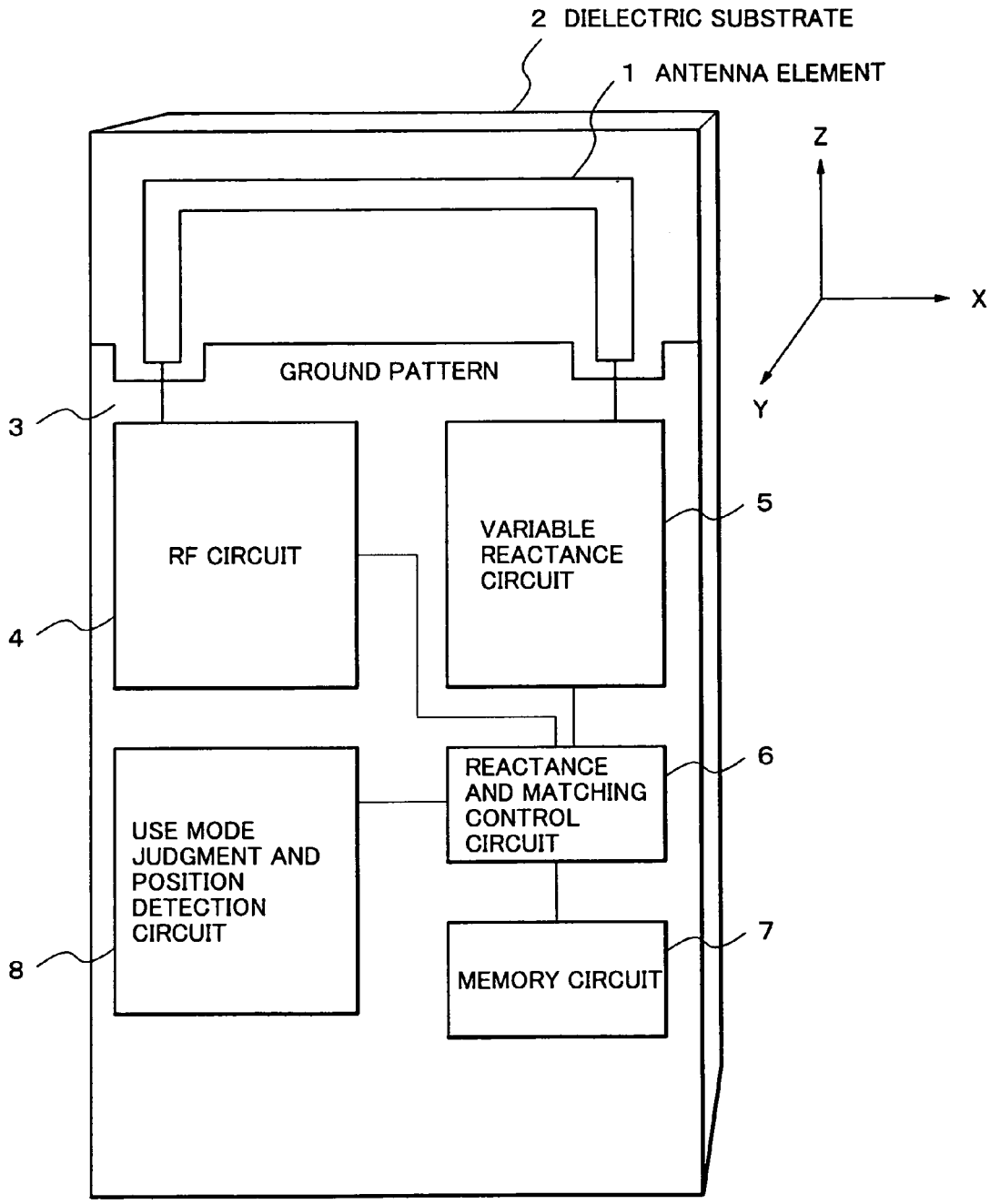
FIG. 1 is a conceptual diagram showing a construction of an antenna device according to a first embodiment of the present invention.

FIG. 1 is a conceptual diagram showing a construction of an antenna device according to a first embodiment of the present invention.

Referring to FIG. 1, the antenna device according to the first embodiment of the present invention includes an antenna element 1, an RF (radio frequency) circuit 4, a variable reactance circuit 5, a reactance and matching control circuit 6, a use mode judgment and position detection circuit 8, and a memory circuit 7. Also, those respective circuits are formed on a dielectric substrate 2 and integrated with each other.

Figure 2:
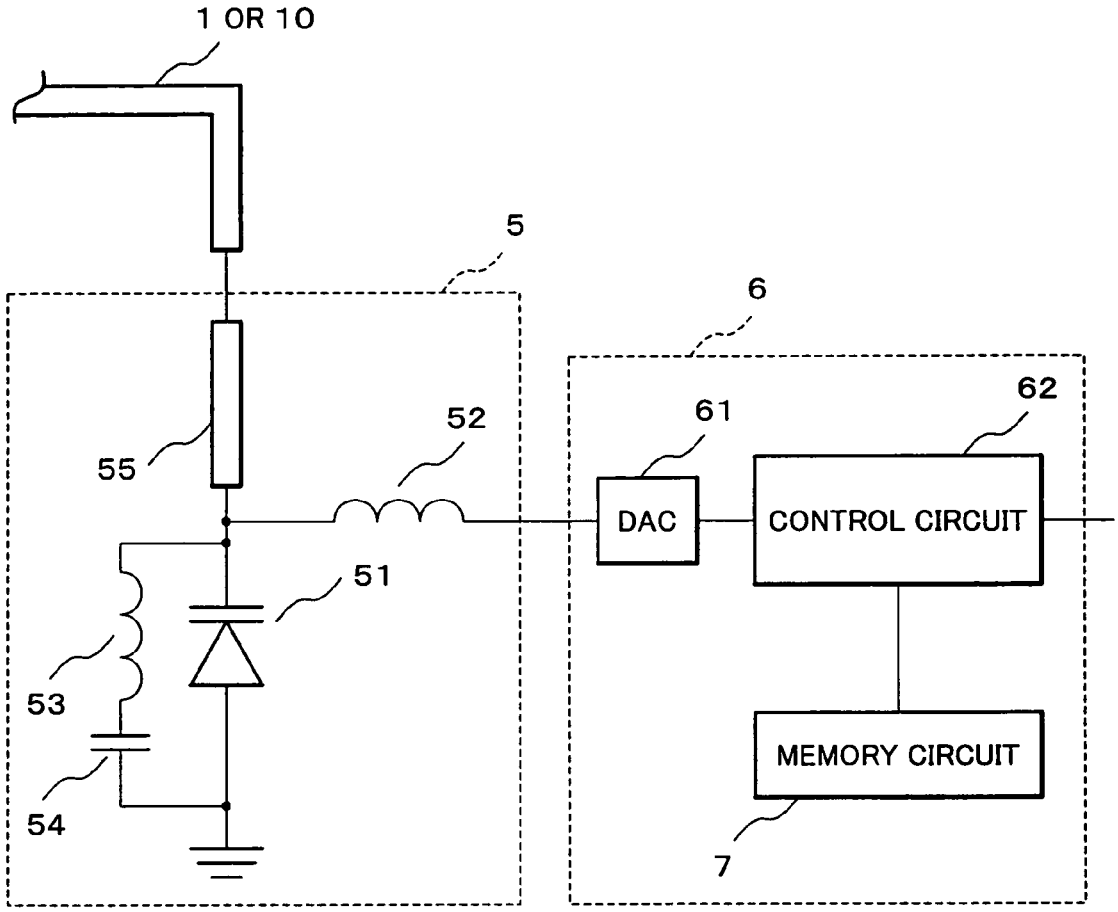
FIG. 2 is a block diagram showing a structural example of a variable reactance circuit and a reactance and matching control circuit shown in FIG. 1.
Figure 3:
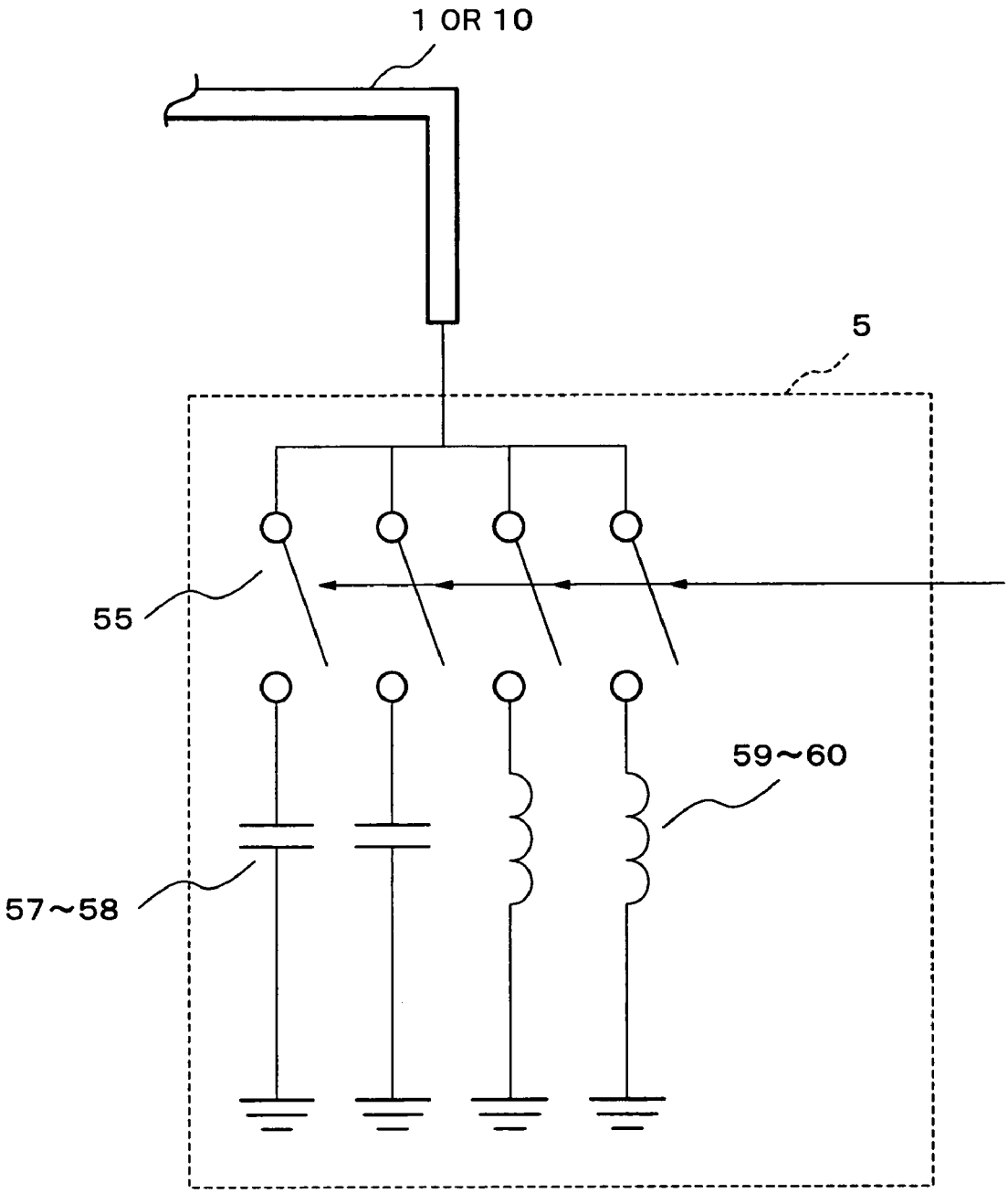
FIG. 3 is a block diagram showing another structural example of the variable reactance circuit shown in FIG. 1.

Then, an operation of the respective sections of the antenna device according to this embodiment will be described with reference to the accompanying drawings. FIG. 2 is a block diagram showing a structural example of the variable reactance circuit and the reactance and matching control circuit shown in FIG. 1. FIG. 3 is a circuit diagram showing another structural example of the variable reactance circuit shown in FIG. 1.

An electrical signal is fed to the antenna element 1 from the RF circuit 4 that is connected to one end of the antenna element 1, and the antenna element 1 is terminated by the variable reactance circuit 5 that is connected to the other end of the antenna element 1. As shown in FIG. 1, the antenna element 1 is constituted by two lines that are disposed substantially in parallel, and one line that is connected substantially perpendicularly to each of ends of the two lines in the same direction. This structure gives the antenna element 1 directivities in the vertical direction and in the horizontal direction.

A conductive pattern (ground pattern 3) is formed on the dielectric substrate 2 except for portions where the respective circuits including the antenna element 1 are formed.

The RF circuit 4 is connected to one end of the antenna element 1 and feeds an electrical signal to the antenna element 1 through a matching circuit (not shown). In order to match impedance at an antenna electricity feeding point, the matching circuit may have plural kinds of switchable circuit elements or variable reactance elements such as varactor diode, to thereby control the impedance.

As shown in FIG. 2, the variable reactance circuit 5 is made up of a varactor diode 51, coils 52 and 53, a capacitor 54, and a strip line 55. The varactor diode 51 changes its reactance value according to a control signal that is inputted through the coil 52. Also, the varactor diode 51 is arranged in parallel with a series circuit composed of the coil 53 and the capacitor 54. With the appropriate selection of a constant of the coil 53, the variable reactance circuit 5 expands a variable range of the impedance.

The coil 52 removes a high frequency noise of an applied voltage that is supplied from the reactance and matching control circuit 6, and the capacitor 54 cuts off a DC voltage that is applied to the coil 53 to prevent the coil 53 from being damaged. Also, the strip line 55 is disposed between the antenna element 1 and the varactor diode 51 in order to shift the variable range of the reactance value of the varactor diode 51.

The provision of the strip line 55 and the coil 53 as described above makes it possible to set to a desirable range the settable reactance value by the varactor diode 51 alone. The strip line 55 may be replaced by a micro strip line or a phase shifter.

Also, the variable reactance circuit 5 is constituted as shown in FIG. 3. That is, the variable reactance circuit 5 is made up of coils 59, 60 and capacitors 57, 58, which constitute reactance elements, and a switch 56 that changes over the connection of the antenna element 1 with the respective reactance elements. The switch 56 is changed over according to a control signal from the reactance and matching control circuit 6 to select a desired reactance element. The construction and the number of reactance elements are not limited to this example, and an arbitrary number of capacitors and coils may be provided.

The reactance and matching control circuit 6 is made up of a DAC (digital analog converter) 61 and a control circuit 62. The reactance and matching control circuit 6 outputs a control signal for setting the reactance value of the variable reactance circuit 5 and the matching conditions of the RF circuit 4 according to control information outputted from the memory circuit 7.

The memory circuit 7 stores control information such as optimum reactance value and matching conditions corresponding to the use state of the antenna device in advance, and outputs the control information in which the antenna element 1 fills a desired directivity characteristic to the reactance and matching control circuit 6, according to detection signals outputted from the use mode judgment and position detection circuit 8.

The use mode judgment and position detection circuit 8 acquires use mode information from a control device (not shown) and presumes the direction or inclination of the antenna device and how to use the radio communication apparatus.

In this example, the control device collects detection signals from various sensors (not shown) which detect the direction or inclination of the antenna device or the use state (use mode) of the radio communication apparatus. Then, the control device generates the use mode information and outputs the generated use mode information to the use mode judgment and position detection circuit 8.

The use modes (use states) include a state in which a call is made while the radio communication apparatus is close to a user's head, and a state in which a call is made using an external microphone or earphone of a head set etc. Also, the use modes include a state in which a TV telephone or data communication is conducted while watching a display screen, and a state in which data communication is conducted by connecting the radio communication apparatus to a personal computer or a PDA (personal digital assistance). In addition, the use modes include a state in which a still image or a moving image is taken by using a built-in camera (not shown).

Also, as various sensors, there can be used a geomagnetic sensor composed of hall elements for detecting the inclination or a sensor for measuring a distance to a human body.

The reactance and matching control circuit 6 may set the value of the variable reactance circuit 5 according to either detection signal of the use state or the direction or inclination of an apparatus into which the antenna device is incorporated, or may set the value of the variable reactance circuit 5 according to both of the detection signals of the state and the direction or inclination of the apparatus into which the antenna device is incorporated. In addition, the use state of the antenna device may be judged together with a use state estimating process that is conducted in the above-mentioned use mode.

The antenna device may be provided with a measurement section for measuring a parameter which indicates the reception quality such as the reception sensitivity, SIR (Signal Interference Ratio), or an error rate. In this case, the reactance and matching control circuit 6 sets the value of the variable reactance circuit 5 and the matching condition of the RF circuit 4 so as to obtain the best measurement results of those parameters.

Figure 4:
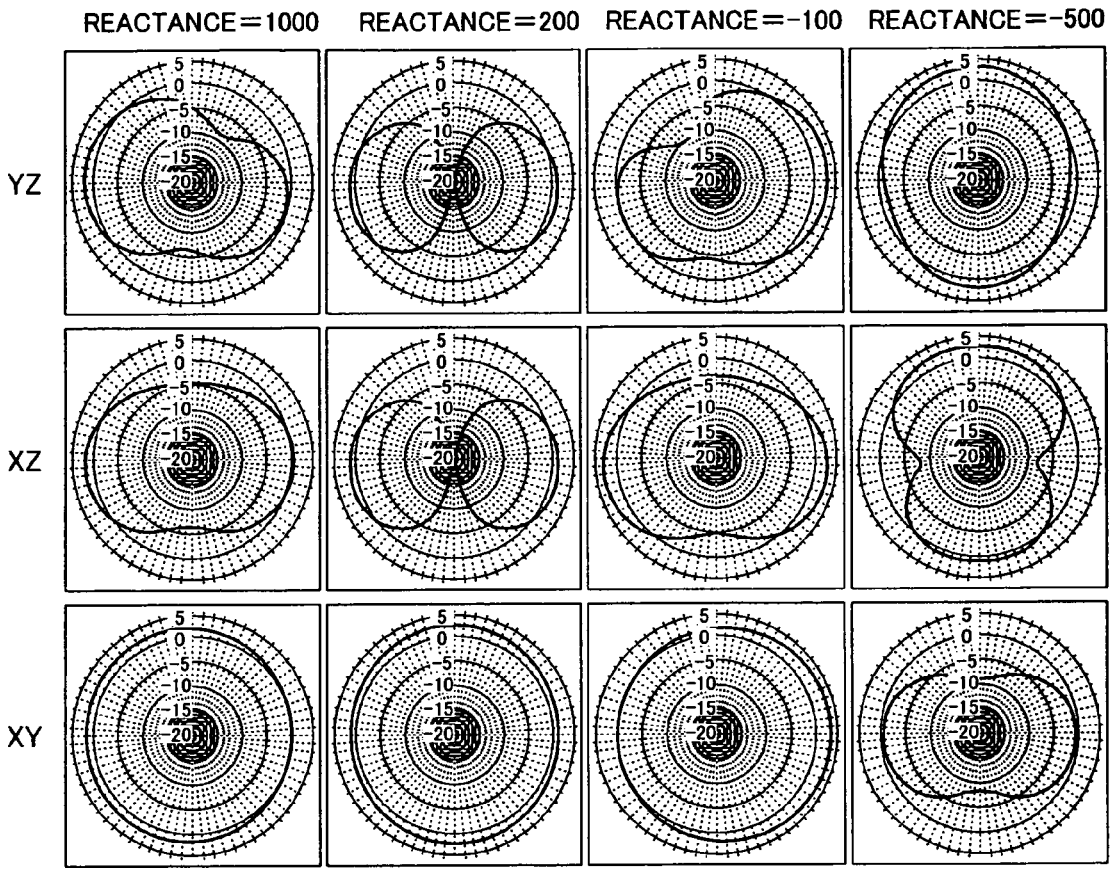
FIG. 4 is a graph illustrative of radiation characteristics of an antenna device shown in FIG. 1.

Then, the operation of the antenna device according to this embodiment will be described in more detail. FIG. 4 is a graph illustrative of the radiation characteristic of an antenna device shown in FIG. 1.

The antenna device shown in FIG. 1 is folded into three portions, that is, has the antenna element 1 having two elements that are substantially in parallel with each other, and one element that is perpendicular to these. An electrical signal is fed to the antenna element 1 from one terminal thereof, and the other terminal of the antenna element 1 is terminated by the variable reactance circuit 5, with the result that the antenna directivity is controlled by adjusting the termination reactance value.

Then, a description will be given of the radiation characteristics of the antenna element 1 on respective three-dimensional planes, that is, a YZ plane, an XZ plane, and an XY plane in the case of defining the coordinate axes X, Y, and Z shown in FIG. 1.

FIG. 4 is a graph illustrative of the radiation characteristic of the antenna device 1 in the case of changing the reactance value of the variable reactance circuit 5.

In this example, the antenna element 1 measures 10 mm in height (Z direction) and 20 mm in width (X direction). The operating frequency of the antenna device 1 is 2 GHz.

The direction of a main lobe that is the largest in the antenna gain changes according to the reactance value of the variable reactance circuit 5. Referring to FIG. 4, the direction is a −X direction when a relative value of the reactance is 1,000, a ±Y direction when the reactance value is 200, a +X direction when the reactance value is −100, and a +Z direction when the reactance value is −500. Accordingly, when the reactance value (relative value) of the variable reactance circuit 5 successively changes in the order of 1,000, 200, −100, −500, and 1,000, the direction of a main lobe of the antenna element 1 changes in the order of −X, ±Y, +X, +Z, and −X.

With the change in the reactance value of the variable reactance circuit 5 in this manner, a desired antenna directivity can be obtained.

Here, in the antenna device according to this embodiment, the impedance at the electricity feeding point changes along with the change in the value of the variable reactance circuit 5, and the matching conditions of the RF circuit 4 and the antenna element 1 change. For that reason, the RF circuit 4 has a matching circuit (not shown) for changing over the impedance at the electricity feeding point. The reactance and matching control circuit 6 controls the impedance constant of the matching circuit in the RF circuit 4 at the same time in order to prevent the impedance mismatching at the electricity feeding point when controlling the reactance value of the variable reactance circuit 5. As a result, the reception sensitivity of the antenna device is prevented from being deteriorated.

As described above, according to the antenna device of this embodiment, since the impedance value of the electricity feeding section and the reactance value of the termination section in the antenna element 1 are controlled at the same time to optimize the antenna directivity, thereby making it possible to obtain the optimum reception sensitivity or communication quality according to the use state.

(Second Embodiment)

Figure 5:
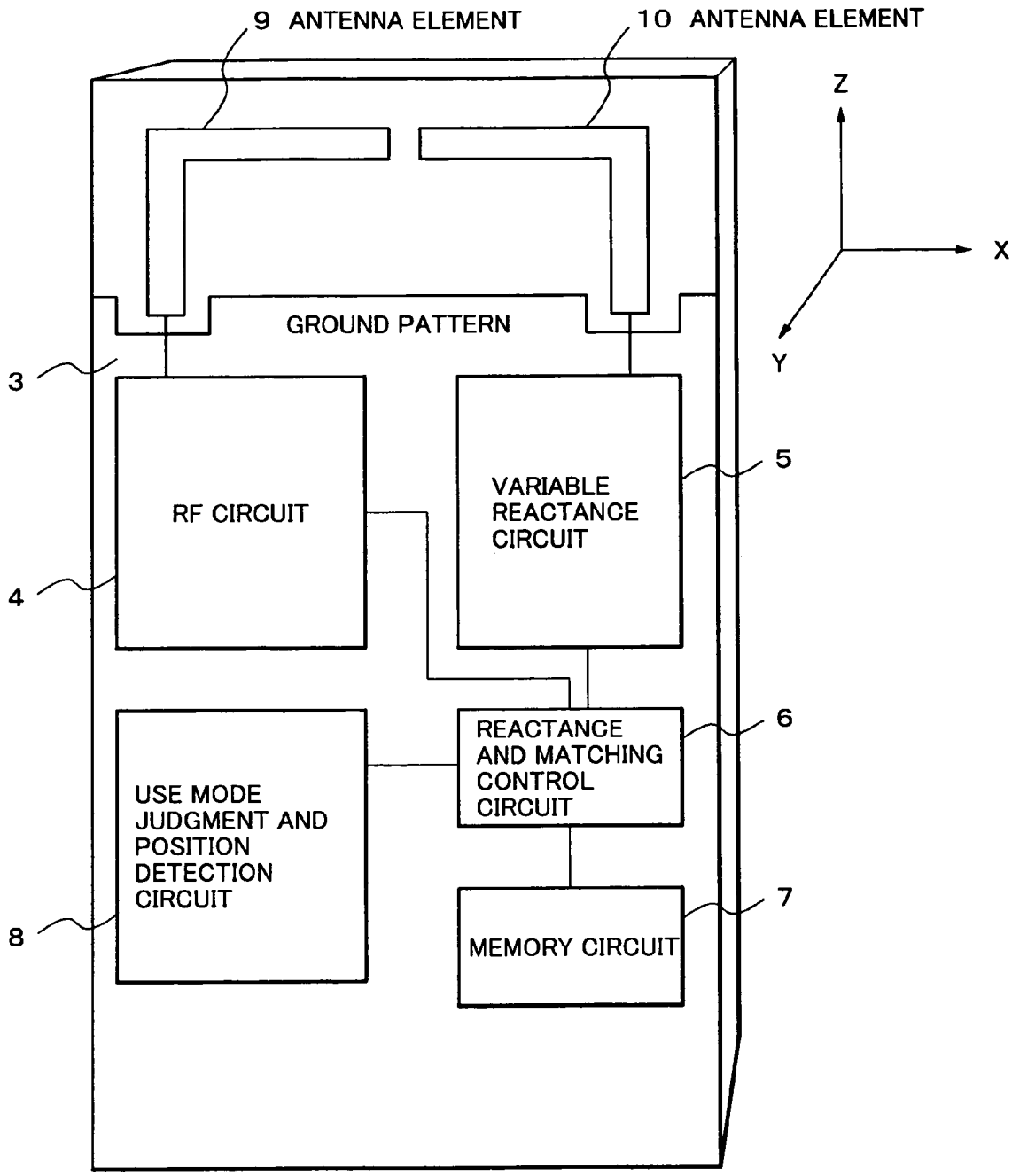
FIG. 5 is a conceptual diagram showing a construction of an antenna device according to a second embodiment of the present invention.

Next, an antenna device according to a second embodiment of the present invention will be described. FIG. 5 is a conceptual diagram showing a construction of the antenna device according to the second embodiment of the present invention.

In FIG. 5, the antenna device is different from that in FIG. 1 in that the antenna element 1 is divided into antenna elements 9 and 10. In the antenna element 1 shown in FIG. 1, because an electrical signal is fed from one terminal of the antenna element 1, and the other terminal of the antenna element 1 is terminated by the reactance element, in the case where element length is shorter, the resonance frequency of the antenna element 1 does not coincide with the use frequency, and the impedance matching at the electricity feeding point is difficult.

As shown in FIG. 5, the antenna device according to the second embodiment is of a two-element structure in which the antenna element 1 shown in FIG. 1 is divided into the two L-shaped antenna elements 9 and 10. In this example, the two antenna elements 9 and 10 are electromagnetically coupled together in a space, thereby are able to obtain the same radiation characteristics as those of the antenna element according to the first embodiment shown in FIG. 1. Since the port of no feed of the antenna element 9 shown in FIG. 5 is opened, it is possible to make the resonance frequency of the antenna element readily coincide with the use frequency. As a result, the impedance at the electricity feeding point can be readily matched. Other constructions are identical with those in the first embodiment, and therefore their description will be omitted.

In the antenna device according to the second embodiment, it is necessary to set the reactance value to a value different from that in the first embodiment, but it is possible to obtain the same directivity characteristic as that in the antenna device according to the first embodiment shown in FIG. 4.

(Third Embodiment)

Figure 6:
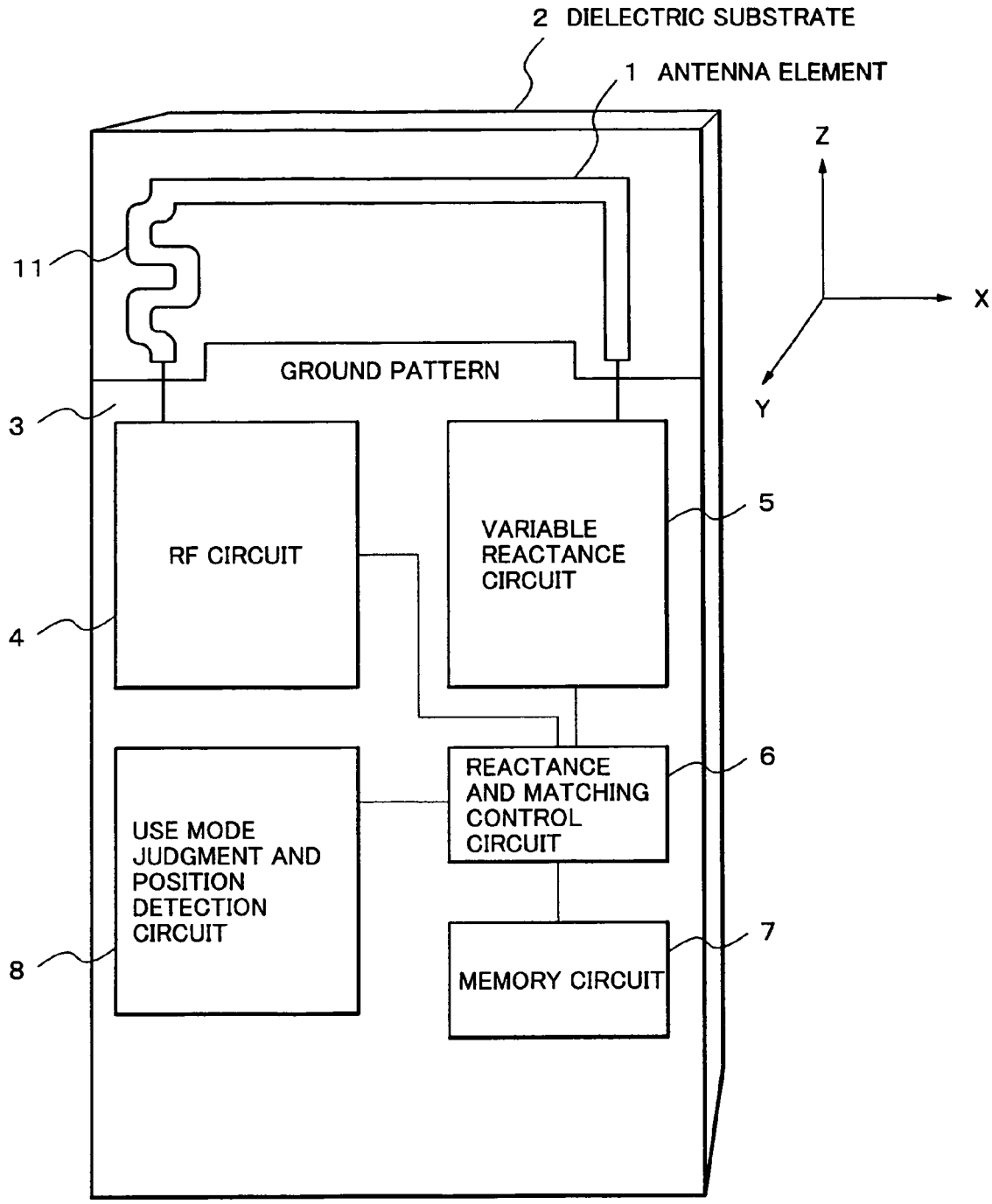
FIG. 6 is a conceptual diagram showing a construction of an antenna device according to a third embodiment of the present invention.

Next, an antenna device according to a third embodiment of the present invention will be described. FIG. 6 is a conceptual diagram showing a construction of the antenna device according to the third embodiment of the present invention.

In FIG. 6, the antenna device is different from that in FIG. 1 in that a part of the antenna element 1 is transposed to a meandering line 11. In this case, element length occupied in an actual area can be shorter by transposing a portion or all on a straight line-like to meandering line 11. Other constructions are identical with those in the first embodiment, and therefore their description will be omitted.

(Fourth Embodiment)

Figure 7:
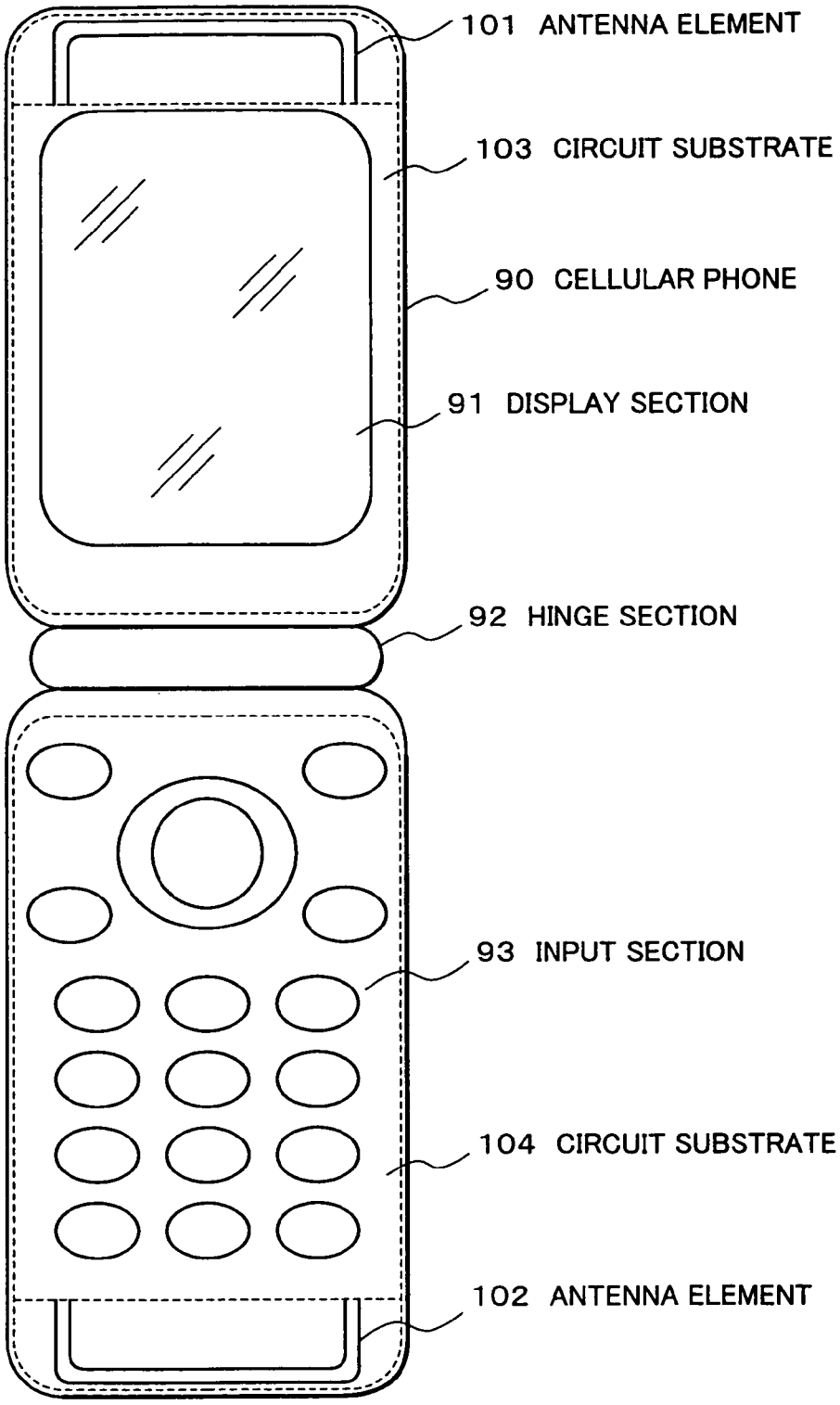
FIG. 7 is a conceptual diagram showing a construction of an antenna device according to a fourth embodiment of the present invention.

Subsequently, a flip type cellular phone will be described as an example of the radio communication apparatus using the antenna device according to the present invention. FIG. 7 is a plan view showing the appearance of the cellular phone as an antenna device according to a fourth embodiment of the present invention.

Referring to FIG. 7, a cellular phone 90 has an upper casing and a lower casing coupled with each other through a hinge section 92. The upper casing is equipped with a circuit substrate 103 having an antenna element 101 formed thereon and a display section 91. The lower casing is equipped with a circuit substrate 104 having an antenna element 102 formed thereon and an input section 93.

The cellular phone 90 includes a selector device for selecting any one of the antenna elements 101 and 102 so that only the selected antenna is available. The cellular phone 90 also includes a synthesizing device for synthesizing the reception signals of the antenna elements 101 and 102, and can synthesize those signals at the maximum ratio. Also, the antenna elements 101 and 102 may be mounted in the vicinity of the hinge section 92 or in other portions.

In the fourth embodiment, the antenna element excellent in the reception sensitivity is selected, or the maximum-ratio synthesis is made, thereby it is possible to obtain the antenna directivity characteristic equal to or higher than that shown in FIG. 4.

The antenna elements 101 and 102 can be created by using a conductive pattern, a metal wire, a metal plate, and so on, for example, a dielectric substrate or the circuit substrates 103, 104 made of FPC (flexible printed circuit).

Also, if the two antenna elements 101 and 102 can be arranged to be perpendicular to each other according to the configuration of the radio communication apparatus, the antenna directivity is enhanced, and the reception sensitivity can be further improved.

In addition, if three or more antenna elements described in the first, second or third embodiment can be arranged at intervals corresponding to the transmission and reception frequencies, these antenna elements can be used as an array antenna.

In the construction where a plurality of antenna elements are arranged, because the antenna device according to the present invention can control the directivity for each of the antenna elements, the number of antenna elements can be reduced in case of aiming to obtain the same directivity characteristic as that in the conventional antenna device.

In the fourth embodiment, the antenna device described in the first, second or third embodiment is applied to the flip type cellular phone. Similarly, the above antenna device can be incorporated into the cellular phones of various configurations (a straight type, a slide type, a turn type, a rotating biaxial mechanism type, etc.) as well as a radio communication apparatus used in a WLAN (wireless local area network) or an RFID (radio frequency identification).

While this invention has been described in connection with certain preferred embodiments, it is to be understood that the subject matter encompassed by way of this invention is not to be limited to those specific embodiments. On the contrary, it is intended for the subject matter of the invention to include all alternative, modification and equivalents as can be included within the spirit and scope of the following claims.

What is claimed is:

1. An antenna device, comprising:

a variable reactance circuit having a reactance value variable on the basis of a control signal;

an RF circuit having a matching circuit at an output side;

an antenna element having one end to which an electrical signal is fed from the RF circuit and the other end terminated by the variable reactance circuit; and a reactance and matching control circuit that outputs the control signal for setting the reactance value of the variable reactance circuit to a predetermined value, wherein the antenna element includes a plurality of lines electrically connected continuously.

2. An antenna device, comprising:

a variable reactance circuit having a reactance value variable on the basis of a control signal;

an RF circuit having a matching circuit at an output side;

an antenna element having one end to which an electrical signal is fed from the RF circuit and the other end terminated by the variable reactance circuit; and a reactance and matching control circuit that outputs the control signal for setting the reactance value of the variable reactance circuit to a predetermined value, wherein the antenna element comprises first, second, and third elements, and wherein the first and third elements are arranged at a predetermined interval in the same direction, and the second element is connected perpendicularly to the first and third elements.

3. An antenna device according to claim 2, wherein the second element of the antenna element is divided into at least two pieces at a predetermined interval.

4. An antenna device according to claim 1, wherein the antenna element is made a part or all over into a meandering line.

5. An antenna device according to claim 1, wherein the variable reactance circuit comprises:

a varactor diode having a capacitor changed according to a signal from the outside;

a strip line that is inserted between the antenna element and the varactor diode; and a coil that is connected in parallel with the varactor diode.

6. An antenna device, comprising:

a variable reactance circuit having a reactance value variable on the basis of a control signal;

an RF circuit having a matching circuit at an output side;

an antenna element having one end to which an electrical signal is fed from the RF circuit and the other end terminated by the variable reactance circuit; and a reactance and matching control circuit that outputs the control signal for setting the reactance value of the variable reactance circuit to a predetermined value, wherein the reactance and matching control circuit conducts control to change an antenna matching constant with respect to the matching circuit in the RF circuit in synchronism with the control signal for setting the reactance value of the variable reactance circuit to the predetermined value.

7. An antenna device according to claim 6, further comprising:

a use mode judgement circuit that detects a use state of the antenna device;

a position detection circuit that detects a direction or inclination of the antenna device; and a reception measurement section for measuring a reception quality of the antenna device, wherein the reactance and matching control circuit makes the variable reactance circuit change the reactance value and the RF circuit change the matching constant according to a detection result that is outputted from any one of the use mode judgement circuit, the position detection circuit, and the reception measurement section.

8. An antenna device according to claim 7, further comprising a memory circuit that stores optimum reactance values corresponding to the use state, the direction, the inclination, and the reception quality of the antenna device, wherein the reactance and matching control circuit reads the optimum reactance value stored in the memory circuit according to the detection result that is outputted from any one of the use mode judgement circuit, the position detection circuit, and the reception measurement section to make the variable reactance circuit change the reactance value, and make the RF circuit change the matching constant.

9. A radio communication apparatus, comprising a plurality of the antenna devices according to claim 1, the radio communication apparatus selecting any one from the plurality of antenna devices, or selecting and synthesizing two or more of the antenna devices to provide a reception signal.

10. A radio communication apparatus, comprising a plurality of the antenna devices according to claim 2, the radio communication apparatus selecting any one from the plurality of antenna devices, or selecting and synthesizing two or more of the antenna devices to provide a reception signal.

11. A radio communication apparatus, comprising a plurality of the antenna devices according to claim 3, the radio communication apparatus selecting any one from the plurality of antenna devices, or selecting and synthesizing two or more of the antenna devices to provide a reception signal.

12. A radio communication apparatus, comprising a plurality of the antenna devices according to claim 4, the radio communication apparatus selecting any one from the plurality of antenna devices, or selecting and synthesizing two or more of the antenna devices to provide a reception signal.

13. A radio communication apparatus, comprising a plurality of the antenna devices according to claim 5, the radio communication apparatus selecting any one from the plurality of antenna devices, or selecting and synthesizing two or more of the antenna devices to provide a reception signal.

14. A radio communication apparatus, comprising a plurality of the antenna devices according to claim 6, the radio communication apparatus selecting any one from the plurality of antenna devices, or selecting and synthesizing two or more of the antenna devices to provide a reception signal.

15. A radio communication apparatus, comprising a plurality of the antenna devices according to claim 7, the radio communication apparatus selecting any one from the plurality of antenna devices, or selecting and synthesizing two or more of the antenna devices to provide a reception signal.

16. A radio communication apparatus, comprising a plurality of the antenna devices according to claim 8, the radio communication apparatus selecting any one from the plurality of antenna devices, or selecting and synthesizing two or more of the antenna devices to provide a reception signal.

* * * * *